US005385799A

United States Patent [19]

Ono et al.

[11] Patent Number: 5,385,799

[45] Date of Patent: Jan. 31, 1995

[54] TONER FOR DEVELOPMENT OF ELECTROSTATIC IMAGE

[75] Inventors: Hitoshi Ono, Yokohama; Osamu Ando, Kawasaki; Masako Takeuchi, Yokohama, all of Japan

[73] Assignee: Mitsubishi Kasei Corporation, Tokyo, Japan

[21] Appl. No.: 993,692

[22] Filed: Dec. 21, 1992

[30] Foreign Application Priority Data

Dec. 20, 1991 [JP] Japan ..... 3-339069

[51] Int. Cl.[6] ..... G03G 9/097

[52] U.S. Cl. ..... 430/110; 430/106

[58] Field of Search ..... 430/106, 109, 110

[56] References Cited

U.S. PATENT DOCUMENTS

| | | | |
|---|---|---|---|
| 4,099,968 | 7/1978 | Scouten et al. | 96/15 D |
| 4,147,645 | 4/1979 | Lu | 252/62.1 |
| 4,571,369 | 2/1986 | Yamashita | 430/106 |
| 4,576,888 | 3/1986 | Miyakawa et al. | 430/106 |
| 4,624,907 | 11/1986 | Niimura et al. | 430/106 |
| 5,188,918 | 2/1993 | Ziolo | 430/106 |

OTHER PUBLICATIONS

Japanese Laid Open Publication (Kokai) No. JP-A-59/165069 (1984) Inoue et al.

*Primary Examiner*—John Goodrow

*Attorney, Agent, or Firm*—Oblon, Spivak, McClelland, Maier, & Neustadt

[57] ABSTRACT

A toner for development of electrostatic images containing one or more compounds of formulae (I) and (II):

(I)

where A and R each represent an aromatic ring residue, and the hydroxyl group and the amido group in the formula are bonded to the aromatic ring A at the adjacent positions, (II)

where $A^1$, $A^2$, $R^1$ and $R^2$ each represent an aromatic ring residue, and the hydroxyl group and the amido group in the formula are bonded to the aromatic ring $A^1$ or $A^2$ at the adjacent positions; and n represents an integer. The toner is highly safe and has sufficient charge properties and charge stability.

19 Claims, No Drawings

TONER FOR DEVELOPMENT OF ELECTROSTATIC IMAGE

BACKGROUND OF THE INVENTION

1. Field of the Invention

The present invention relates to a toner which is useful for the development of electrostatic images. More particularly, the invention relates to a metal-free toner having excellent charging characteristics.

2. Discussion of Background

Developers for use in electronic duplicators must be capable of sticking to a photoreceptor or to any image carrier having an electrostatic image formed thereon. In order to provide a hard copy of the image, the developer is transferred from the photoreceptor or image carrier to an image receiving sheet where it is fixed. Prior art developers generally fall into one of two categories: two-component developers comprising a carrier and a toner and one-component developers (magnetic toners) not containing any carrier.

An important characteristic of a toner is its charging property. That is, to be useful, a toner must be capable of being charged, positively or negatively, to a suitable level by virtue of its contact with a carrier or with a developer tank wall. Further, the toner charge level must remain stable during continuous use or under extreme conditions.

The charging property of a toner may be affected by the presence of a binder resin and a colorant, but the presence of these materials is often insufficient to provide the desired level of performance. The incorporation of certain agents in toners (i.e., charge controlling agents) for modifying charging properties is known, and the agents include, for example, positive charging nigrosine dyes and quaternary ammonium salts and negative charging metal-containing monoazo dyes, salicylic acid-metal complexes and copper phthalocyanine pigments.

Unfortunately, these conventional charge controlling agents have several problems associated with them that limit their effectiveness in providing toners with adequate charging properties and other important toner characteristics.

One problem encountered with prior art charge controlling agents is that they increase the safety risk associated with toners containing them. Almost all conventional charge controlling agents, especially negative charge controlling agents, are metal-containing dyes containing, for example, chromium metal. Since a toner is used in places which are often in extremely close proximity to humans, the presence of toxic metals in toners is dangerous to office workers, etc.. The recent trend towards safe workplaces, etc., and the desire to eliminate dangerous and toxic substances from areas with high human traffic has created a need for a charge controlling agent for toners which does not contain toxic metals like chromium but which has charging properties as good as or better than conventional agents.

A further problem encountered with prior art charge controlling agents is that the charging stability provided by the agents is poor. While many of the conventional charge controlling agents provide a high initial charging level, they do not provide sufficient charging stability over time. Therefore, when these agents are used under continuous duplication or continuous printing conditions, the charging level of the toners incorporating these agents varies with time, providing uneven copies and stained copies. With the increase in demand for rapid-processing duplicators capable of continuously and rapidly duplicating large amounts of copies over long periods of time this problem is growing larger and larger. It was with these considerations in mind that the inventors undertook the development of a charge controlling agent having reduced toxicity and improved charging stability.

OBJECTS OF THE INVENTION

It is one object of the present invention to provide a metal-free toner having an effective charging level and an excellent charging stability while retaining other necessary characteristics, such as moisture resistance, light fastness and heat resistance.

Another object of the present invention is to provide a high quality metal-free toner which is stable even during continuous use under severe conditions for long periods of time so as to yield a stable printing density without any staining of copies.

Another object of the present invention is to provide a safe toner which will not pollute the human environment as compared with conventional toners.

These and other objects as will be readily recognized have been attained by the discovery of a toner for the development of electrostatic images which contains one or more compounds selected from formulae (I) and (II):

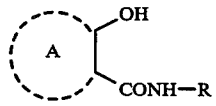

(I)

where A and R each represent an aromatic ring residue, and the hydroxyl group and the amido group in the formula are bonded to the aromatic ring A at adjacent positions,

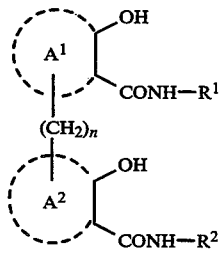

(II)

where $A^1$, $A^2$, $R^1$ and $R^2$ each represent an aromatic ring residue, and the hydroxyl group and the amido group in the formula are bonded to the aromatic rings $A^1$ and $A^2$ at adjacent positions and n represents an integer.

DETAILED DESCRIPTION OF THE INVENTION

The toner for development of electrostatic images of the present invention contains one or more compounds of the preceding formulae (I) and (II). Mixtures of compounds corresponding to both formulae (I) and (II) may also be used.

In formulae (I) and (II), A, $A^1$, $A^2$, R, $R^1$ and $R^2$ each represent an aromatic ring residue which may have one or more substituents on the ring. The aromatic ring may be a 5–10 member aromatic heterocyclic ring, a $C_6$–$C_{20}$ aromatic carbocylic ring or may have a condensed carbocyclic-heterocyclic structure.

Specific examples of the aromatic ring residue include residues of benzene, naphthalene, anthracene, phenanthrene, carbazole, fluorene, fluorenone, dibenzofuran, dibenzothiophene and benzocarbazole. Specific examples of substituents, if any, on the aromatic ring include $C_1$–$C_8$ alkyl groups such as methyl, ethyl, propyl, n-butyl or a tert-butyl; amino; $C_1$–$C_4$ alkoxy, such as a methoxy or an ethoxy; halogen, such as chlorine or bromine; nitro; or phenyl. The number of the substituents on the aromatic ring may be from 1 to 5. If plural substituents are on the ring, they may be same as or different from each other and may be distributed at any position of the ring in any order. A and R in formula (I) as well as $A^1$, $A^2$, $R^1$ and $R^2$ in formula (II) may be same as or different from one another.

In formula (II), the number (n) of carbon atoms in constituting the alkylene chain bonding $A^1$ to $A^2$ is preferably from 1 to 5, more preferably from 1 to 3.

Compounds of formula (I) may be produced according to the following method:

Compounds of general formulae (III) and (IV):

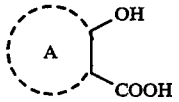

(III)

where A and R have the same meanings as those in formula (I), are reacted in a solvent such as toluene or chlorobenzene at reflux with the addition of phosphorus trichloride thereto, to obtain a compound of formula (I).

Compounds of formula (II) may be produced by a method as described in Brass, Sommer, *Ber.* 61, 998 (1928):

compounds of formulae (V) and (VI):

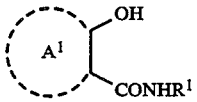

(V)

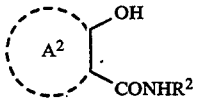

(VI)

where $A^1$, $A^2$, $R^1$ and $R^2$ have the same meanings as those in formula (II), are reacted in alkaline solution with heating at 50° to 120° C., with the addition of formaldehyde thereto, to obtain a compound of formula (II).

Any compound described by formulae (I) and (II) may be incorporated into a toner for development of electrostatic images in the present invention. Preferred compounds are those having the following structural formulae. However, it is to be noted that these compounds are not to be construed as limitative.

Examples of Compounds of Formula (I):

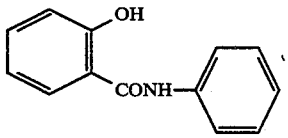

(1)

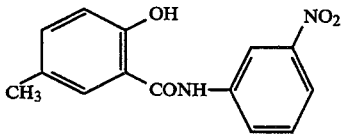

(2)

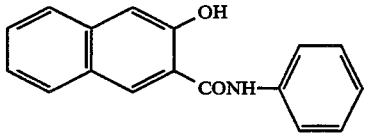

(3)

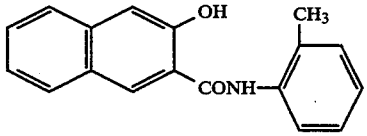

(4)

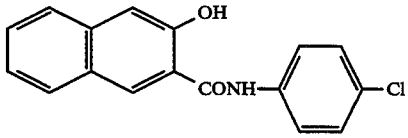

(5)

-continued
(6)
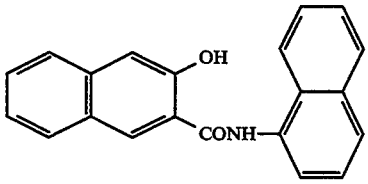
(7)
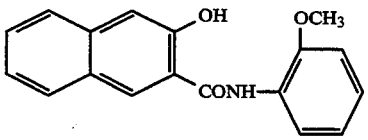
(8)
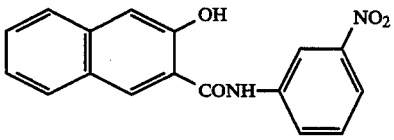
(9)
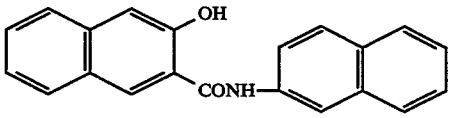
(10)
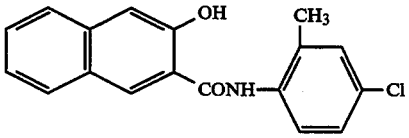
(11)
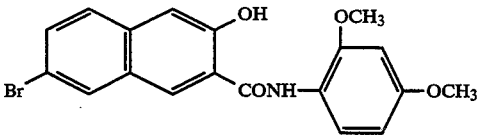
(12)
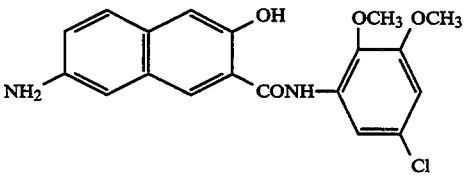
(13)
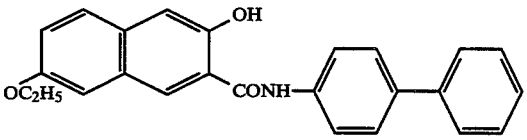
(14)
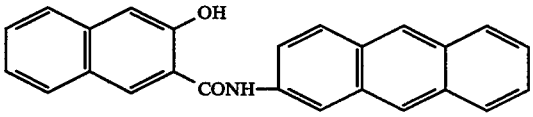
(15)
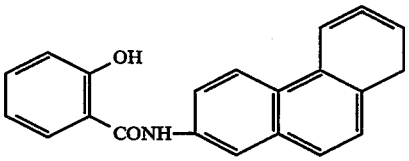

-continued
(16)
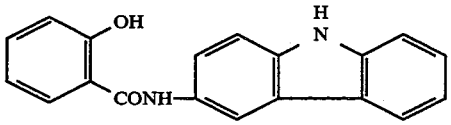
(17)
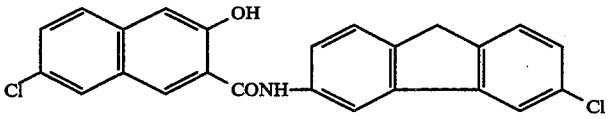
(18)
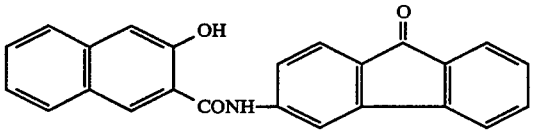
(19)
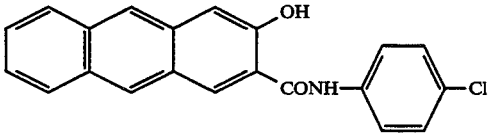
(20)
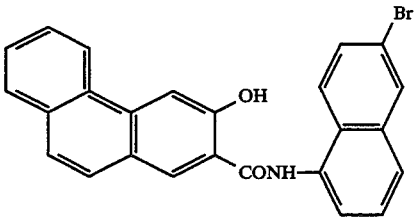
(21)
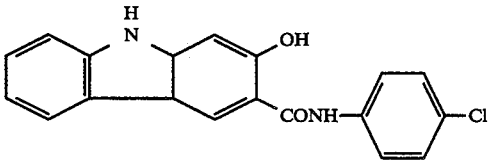
(22)
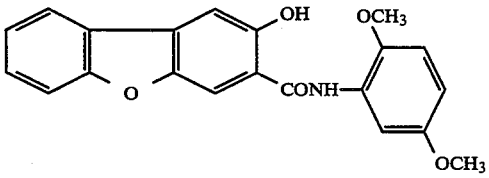
(23)
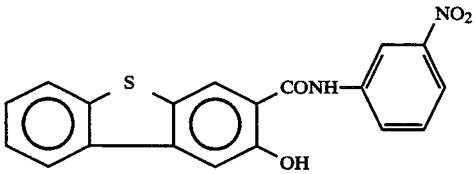
(24)
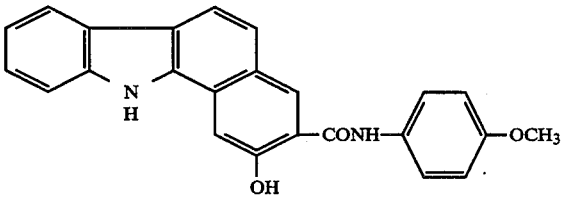

-continued
(25)
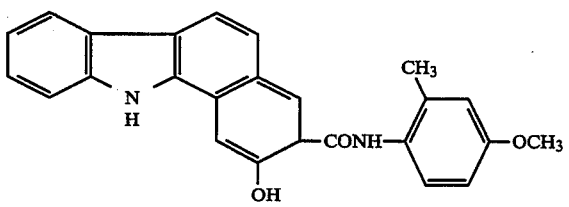
(26)
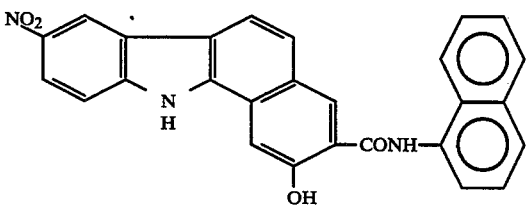
Examples of Compounds of Formula (II):
(27)
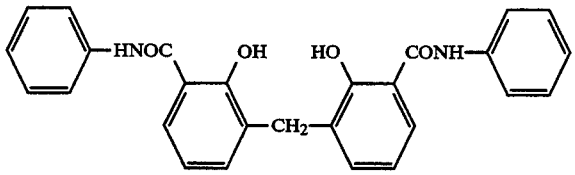
(28)
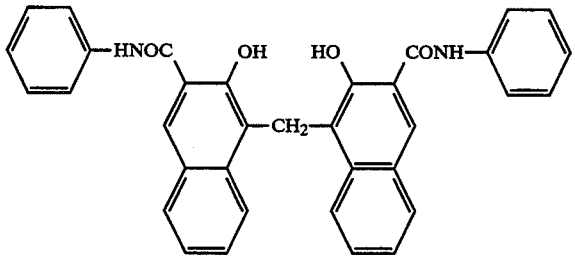
(29)
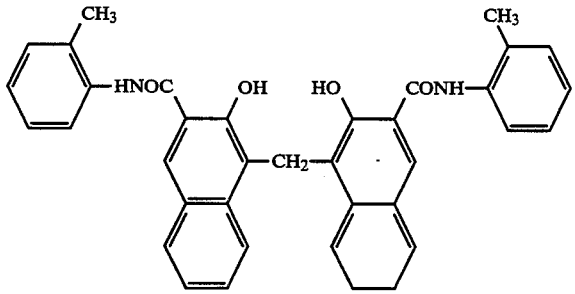
(30)
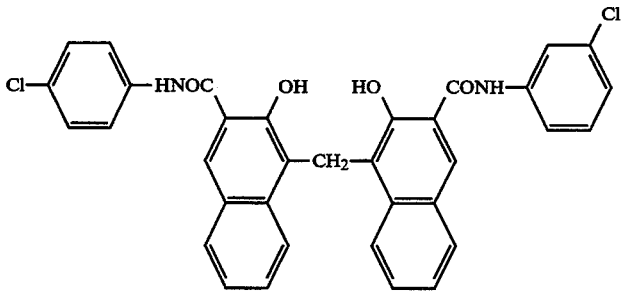

-continued
(31)
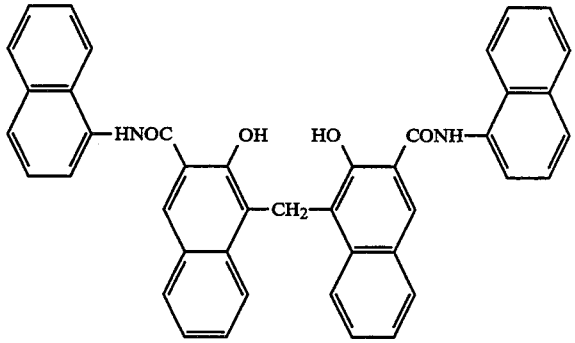
(32)
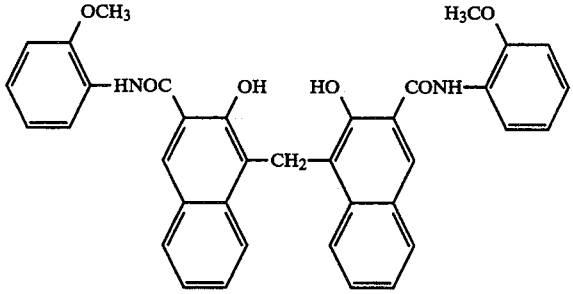
(33)
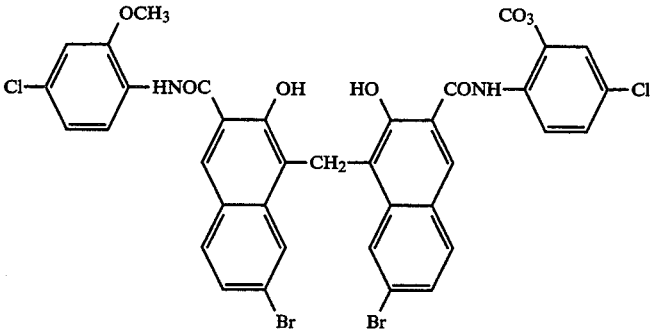
(34)
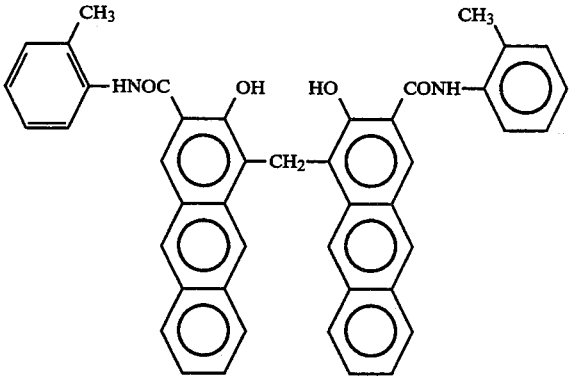
(35)
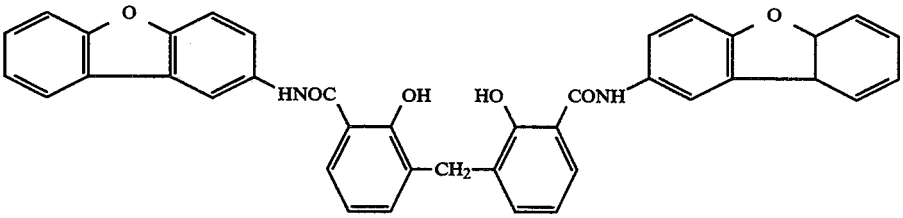

-continued
(36)
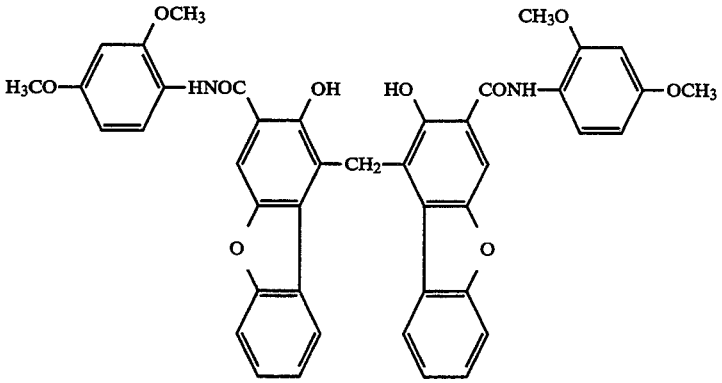
(37)
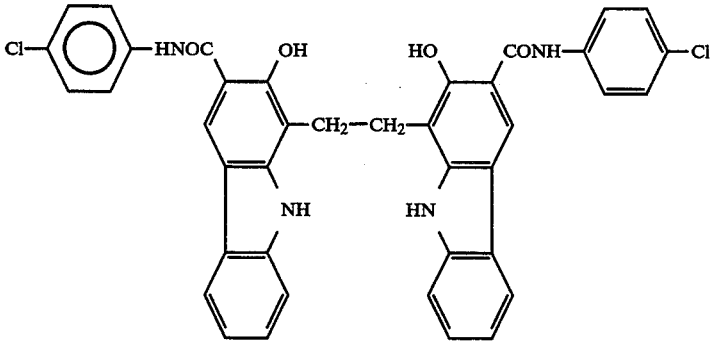
(38)
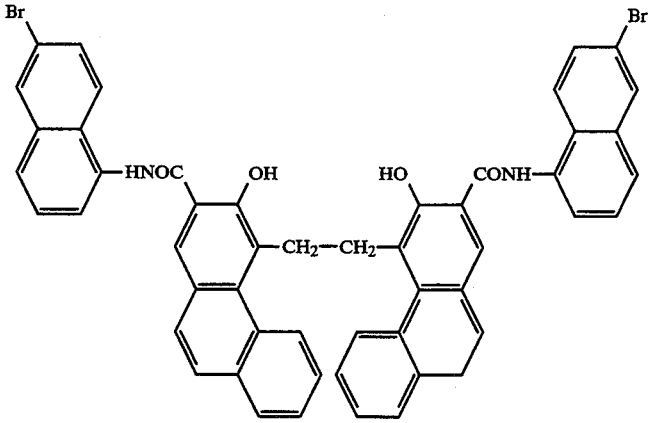
(39)
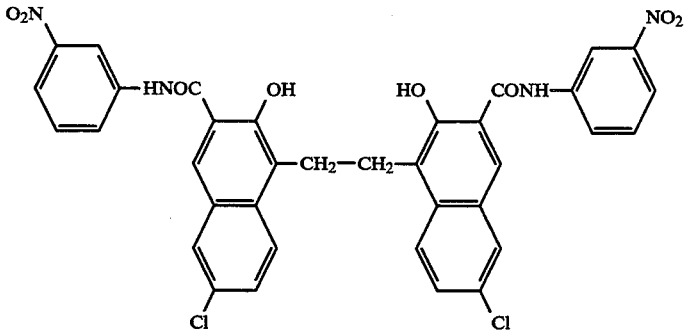

-continued
(40)
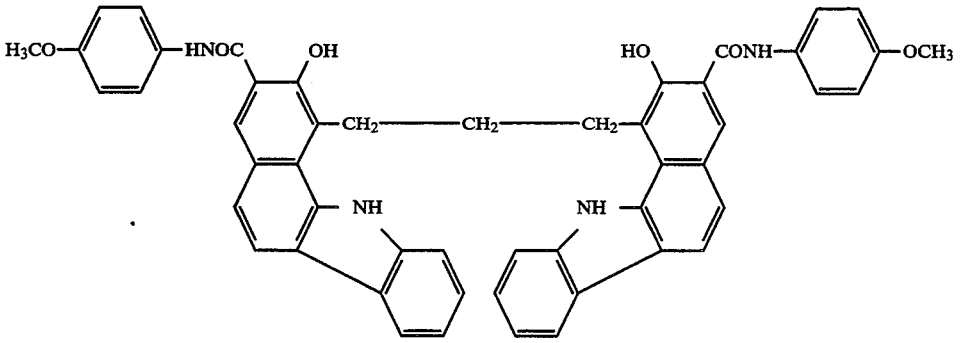
(41)
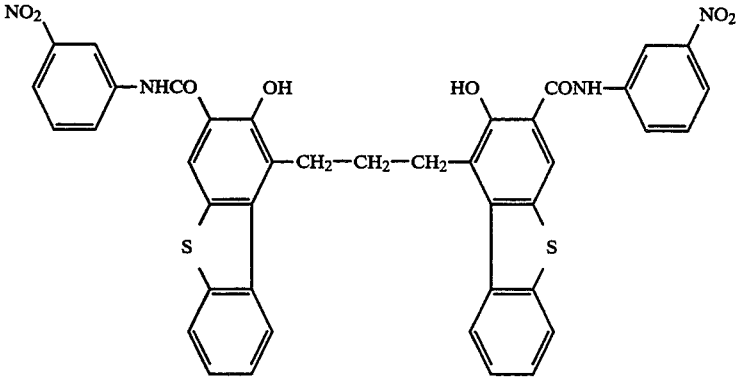
(42)
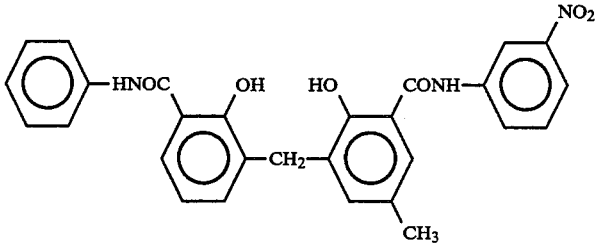
(43)
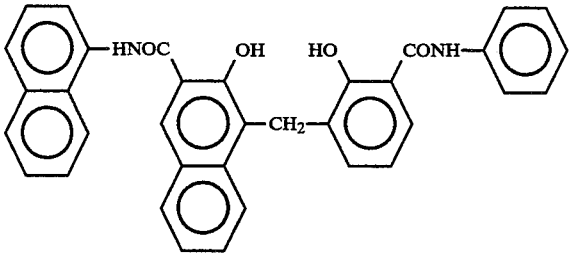
(44)
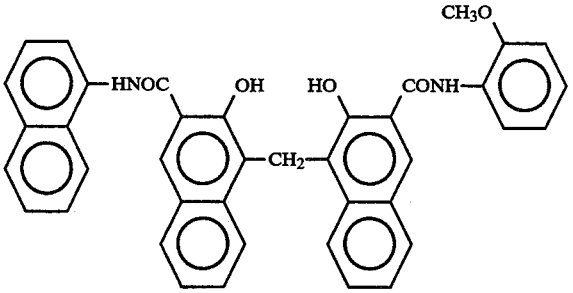

-continued

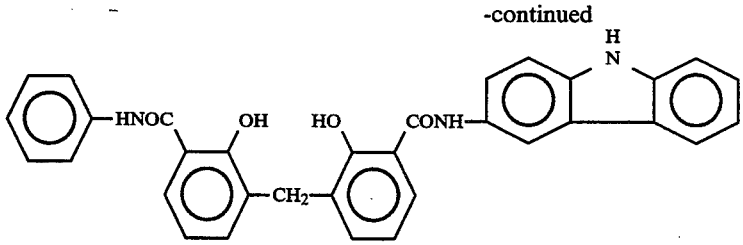

The base toner of the present invention contains a resin, which may be selected from a broad range of known toner resins. For instance, the toner resin may be selected from styrene resins (homopolymers or copolymers containing styrenes or substituted styrenes) such as polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinylacetate copolymer, styrene-maleic acid copolymer, styrene-acrylate copolymers (e.g., styrene-methyl acrylate copolymer, styrene-ethyl acrylate copolymer, styrene-butyl acrylate copolymer, styrene octyl acrylate copolymer or styrene-phenyl acrylate copolymer), styrene-methacrylate copolymers (e.g., styrene-methyl methacrylate copolymer, styrene-ethyl methacrylate copolymer, styrene-butyl methacrylate copolymer and styrene-phenyl methacrylate copolymer), styrene-methyl αchloroacrylate copolymer, or styrene-acrylonitrileacrylate copolymers; as well as vinyl chloride resins, rosin-modified maleic acid resins, phenolic resins, epoxy resins, polyester resins, low molecular weight polyethylene resins, low molecular weight polypropylene resins, ionomer resins, polyurethane resins, silicone resins, ketone resins, ethylene-ethyl acrylate copolymer, xylene resins or polyvinyl butyral resins. Of these, styrene-acrylate copolymers, styrene-methacrylate copolymers, saturated or unsaturated polyester resins or epoxy resins are especially preferred for use in the present invention. The above resins may be incorporated into the toner of the present invention singly or in combination.

The toner of the present invention also contains a colorant, which may be selected from a broad range of known colorants. For instance, the colorant may be selected from dyes or pigments, including carbon black, lamp black, iron black, ultramarine, nigrosine dyes, aniline blue, phthalocyanine blue, phthalocyanine green, Hanza Yellow, Rose Bengal, triarylmethane dyes, monoazo dyes, or disazo dyes.

The compounds of formulae (I) and (II) are pale yellow and they may be incorporated into color toners of blue, red or yellow. As the case may require, colorants (dyes and pigments) each having the necessary color tone may be incorporated into the color toners. The content of the colorant component in the invention toner is preferably from 3 to 20 parts by weight to 100 parts by weight of the resin therein.

For incorporating compound(s) of formulae (I) and (II) and any other additional charge controlling agent(s) into the toner of the present invention, one may use a simultaneous addition method in which the compounds are added to and blended with a toner along with a resin or a separate addition method in which the compounds are added to and blended with toner grains. The simultaneous addition method is more general and thus preferable.

The content of compound(s) of formulae (I) and (II) in the toner of the present invention is preferably from 0.1 to 20 parts by weight, more preferably from 0.5 to 5 parts by weight, most preferably from 1 to 3 parts by weight, to 100 parts by weight of the resin therein. If the content of these compounds is too small, the desired effect of increasing the charge property of the toner will not be attained. If the content of compounds of formula (I) and (II) is too large, the quality of the toner will be decreased. The toner of the present invention may further contain, in addition to compound(s) of formulae (I) and (II), any other charge controlling agent, including known ones, such as nigrosine dyes, quaternary ammonium salts or metal-containing complex compounds, if desired.

The toner of the present invention may also contain any other known additives. For example, ionic conductors such as solid electrolytes, polyelectrolytes, charge transfer complexes or metal oxides (e.g., tin oxide), as well as semiconductors, ferroelectric substances or magnetic substances may be added so as to control the electronic properties of the toner.

The toner of the present invention may further contain other auxiliary additives, such as various types of plasticizers or surface lubricants. For example, low molecular weight olefin polymers may be added for the purpose of controlling the thermal and physical characteristics of the toner. The addition of fine powders of $TiO_2$, $Al_2O_3$ or $SiO_2$ to the toner grains may also be used so as to coat the surfaces of the grains and increase the fluidity and anticoagulating properties of the toner.

For preparing the toner of the present invention, the above-mentioned components may be kneaded in a kneader, cooled, ground and classified. The toner of the present invention may be a two-component developer or a one-component developer (magnetic toner) such as a capsule toner, polymer toner or magnetite-containing toner.

The mean grain size of the toner grains of the present invention may be from 5 to 20 μm. As a carrier to be blended with the toner, any known magnetic substance of iron powder, ferrite or magnetite carrier, as well as a resin-coated carrier prepared by coating a resin on the surface of a magnetic substance and a magnetic resin carrier may be used. Resins useful for preparing a resin-coated carrier include any known resin, such as styrene resins, acrylic resins, styrene-acrylic copolymer resins, silicone resins, modified silicone resins or fluorine resins. However, this list is not to be construed as limiting of the invention.

The mean grain size of the carrier grains is not critical. Preferably, it is from 10 to 200 μm. The proportion of the carrier is preferably from 5 to 100 parts by weight to one part by weight of the toner.

The present invention will be explained in more detail by way of the following examples, which, however, are not intended to restrict the scope of the present invention.

Examples

All "parts" in the following examples are parts by weight, unless otherwise specifically defined.

EXAMPLE 1

| | |
|---|---|
| Styrene Resin (SBM-600, product by Sanyo Chemical Co.) | 100 parts |
| Carbon Black (#44, product by Mitsubishi Kasei Corp.) | 10 parts |
| Compound (3) (the charge controlling agent, (see page 7) | 2 parts |

The above-mentioned components were kneaded, ground and classified to obtain a black toner having a mean grain size of 11 μm. 5 parts of the toner and 100 parts of acrylic resin-coated carrier having a mean grain size of about 100 μm were blended and stirred to prepare a developer. Duplication was effected using this developer with a duplicator having a selenium photoreceptor to give clear copies.

EXAMPLE 2

The same process as in Example 1 was repeated, except that one part of compound (4) was used as the charge controlling agent. Good copies were obtained like those in Example 1.

EXAMPLE 3

The same process as in Example 1 was repeated, except that one part of compound (5) was used as the charge controlling agent. Good copies were obtained like those in Example 1.

EXAMPLE 4

The same process as in Example 1 was repeated, except that one part of compound (6) was used as the charge controlling agent. Good copies were obtained like those in Example 1.

EXAMPLE 5

The same process as in Example 1 was repeated, except that one part of compound (7) was used as the charge controlling agent. Good copies were obtained like those in Example 1.

EXAMPLE 6

The same process as in Example 1 was repeated, except that 3 parts of compound (10) was used as the charge controlling agent. Good copies were obtained like those in Example 1.

EXAMPLE 7

The same process as in Example 1 was repeated, except that 3 parts of compound (14) was used as the charge controlling agent. Good copies were obtained like those in Example 1.

EXAMPLE 8

The same process as in Example 1 was repeated, except that 3 parts of compound (19) was used as the charge controlling agent. Good copies were obtained like those in Example 1.

EXAMPLE 9

The same process as in Example 1 was repeated, except that 2 parts of compound (21) was used as the charge controlling agent. Good copies were obtained like those in Example 1.

EXAMPLE 10

The same process as in Example 1 was repeated, except that 3 parts of compound (25) was used as the charge controlling agent. Good copies were obtained like those in Example 1.

EXAMPLE 11

The same process as in Example 1 was repeated, except that one part of compound (28) was used as the charge controlling agent. Good copies were obtained like those in Example 1.

EXAMPLE 12

The same process as in Example 1 was repeated, except that one part of compound (31) was used as the charge controlling agent. Good copies were obtained like those in Example 1.

EXAMPLE 13

The same process as in Example 1 was repeated, except that one part of compound (32) was used as the charge controlling agent. Good copies were obtained like those in Example 1.

EXAMPLE 14

The same process as in Example 1 was repeated, except that 3 parts of compound (37) was used as the charge controlling agent. Good copies were obtained like those in Example 1.

EXAMPLE 15

The same process as in Example 1 was repeated, except that 3 parts of compound (39) was used as the charge controlling agent. Good copies were obtained like those in Example 1.

EXAMPLE 16

The same process as in Example 1 was repeated, except that 4 parts of compound (40) was used as the charge controlling agent. Good copies were obtained like those in Example 1.

EXAMPLE 17

| | |
|---|---|
| Styrene-acrylic Resin | 100 parts |
| Carbon Black | 7 parts |
| Polypropylene Wax | 1 part |
| Charge Controlling Agent in Table 1 (see infra) | 0.9 part |

The above-mentioned components were kneaded, ground and classified to obtain a black toner. 0.1 of the toner and 9.9 g of iron powder carrier were put in a glass bottle and shaken for 10 minutes. The amount of charge of the prepared blend was measured according to the blow-off method.

TABLE 1

| | Charge Controlling Agent | Amount of Charge μc/g |
|---|---|---|
| Example 17-A | Compound (6) | −25.5 |
| Example 17-B | Compound (31) | −37.5 |
| Example 17-C | Compound (32) | −28.0 |
| Comparative Example 17-D | Chromium-containing Monoazo Dye(*) | −28.0 |

(*)S-34, product of Orient Chemical Co.

From the experiment, it is understood that the compounds of the present invention provide a charging property comparable to a conventional metal-containing charge controlling agent.

As has been explained in detail above, the toner for development of electrostatic images of the present invention is highly safe, has an effective charging level and excellent charging stability, and does not cause the staining of copies.

While the invention has been described in detail and with reference to specific embodiments thereof, it will be apparent to one skilled in the art that various changes and modifications can be made therein without departing from the spirit and scope thereof. Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A toner for the development of electrostatic images, comprising a resin, a colorant and at least one compound of formulae (I) or (II):

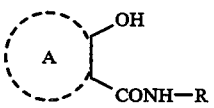

(I)

where A and R, which may be the same or different, each represent an aromatic ring residue selected from the group consisting of benzene, naphthalene, anthracene, phenanthrene, carbazole, fluorene, fluorenone, dibenzofuran, dibenzothiophene and benzocarbazole, where each of the foregoing residues may be substituted by an alkyl, an amino, an alkoxy, a halogen, a nitro or a phenyl, wherein the hydroxyl group and the amido group in the formula are bonded to the aromatic ring A at adjacent positions,

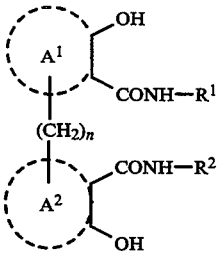

(II)

where $A^1$, $A^2$, $R^1$ and $R^2$, which may be the same or different, each represent an aromatic ring residue, and the hydroxyl groups and the amido groups in the formula are bonded to aromatic rings $A^1$ and $A^2$ at adjacent positions and n represents an integer of from 1 to 5.

2. A toner for the development of electrostatic images as claimed in claim 1, wherein the at least one compound of formula (I) or (II) is represented by formula (I):

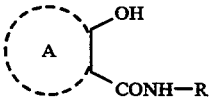

(I)

where A and R, which may be the same or different, each represent an aromatic ring residue, and the hydroxyl group and the amido group in the formula are bonded to aromatic ring residue A at adjacent positions.

3. The toner for the development of electrostatic images of claim 1, wherein said colorant is selected from the group consisting of carbon black, lamp black, iron black, ultramarine, nigrosine dyes, aniline blue, phthalocyanine blue, phthalocyanine green, Hanza Yellow, Rose Bengal, triarylmethane dyes, monoazo dyes, disazo dyes and a mixture thereof.

4. A toner for the development of electrostatic images as claimed in claim 2, wherein A and R in formula (I) each are an aromatic ring residue having at least one substituent thereon selected from the group consisting of an alkyl, an amino, an alkoxy, a halogen, a nitro and a phenyl.

5. A toner for the development of electrostatic images as claimed in claim 2, wherein R in formula (I) is an aromatic ring residue having at least one substituent selected from the group consisting of an alkyl, an amino, an alkoxy, a halogen, a nitro and a phenyl.

6. A toner for the development of electrostatic images as claimed in claim 2, wherein A in formula (I) is an aromatic ring residue selected from the group consisting of naphthalene, anthracene, carbazole and benzocarbazole.

7. A toner for the development of electrostatic images as claimed in claim 2, wherein R in formula (I) is an atomatic ring residue selected from the group consisting of benzene, naphthalene and anthracene.

8. A toner for the development of electrostatic images as claimed in claim 2, wherein A in formula (I) is a naphthalene ring residue and R is a benzene or naphthalene ring residue.

9. A toner for the development of electrostatic images as claimed in claim 1, wherein the at least one compound of formulae (I) or (II) is represented by formula (II):

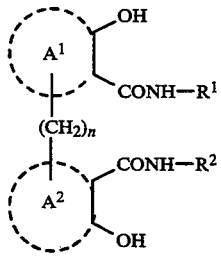

(II)

where $A^1$, $A^2$, $R^1$ and $R^2$, which may be the same or different, each represent an aromatic ring residue, and the hydroxyl groups and the amido groups in the formula are bonded to aromatic rings $A^1$ and $A^2$ at adjacent positions, and n represents an integer of from 1 to 5.

10. A toner for the development of electrostatic images as claimed in claim 9, wherein $A^1$, $A^2$, $R^1$ and $R^2$ in formula (II) each are an aromatic ring residue selected from the group consisting of benzene, naphthalene, anthracene, phenanthrene, carbazole, fluorene, fluorenone, dibenzofuran, dibenzothiophene and benzocarbazole where each of the foregoing residues may be substituted by an alkyl, an amino, an alkoxy, a halogen, a nitro or a phenyl.

11. A toner for the development of electrostatic images as claimed in claim 9, in which $A^1$, $A^2$, $R^1$ and $R^2$ in formula (II) each are an aromatic ring residue having at least one substituent selected from the group consisting of an alkyl, an amino, an alkoxy, a halogen, a nitro and a phenyl.

12. A toner for the development of electrostatic images as claimed in claim 9, wherein one or both of $R^1$ and $R^2$ in formula (II) is an aromatic ring residue having one or more substituents selected from the group consisting of an alkyl, an amino, an alkoxy, a halogen, a nitro and a phenyl.

13. A toner for the development of electrostatic images as claimed in claim 9, wherein one or both of $A^1$ and $A^2$ in formula (II) is an aromatic ring residue selected from the group consisting of naphthalene, anthracene, carbazole and benzocarbazole.

14. A toner for the development of electrostatic images as claimed in claim 9, wherein one or both of $R^1$ and $R^2$ in formula (II) is an aromatic ring residue selected from the group consisting of benzene, naphthalene and anthracene.

15. A toner for the development of electrostatic images as claimed in claim 9, wherein one or both of $A^1$ and $A^2$ in formula (II) is a naphthalene ring residue and one or both of $R^1$ and $R^2$ is a benzene or naphthalene ring residue.

16. A toner for the development of electrostatic images as claimed in claim 9, wherein $A^1$ and $A^2$, or $R^1$ and $R^2$, are identical.

17. A toner for the development of electrostatic images as claimed in claim 1, wherein the at least one compound of formulae (I) and (II) is present in an amount of from 0.1 to 15 parts by weight to 100 parts by weight of the resin therein.

18. The toner for the development of electrostatic images of claim 1, wherein said toner is metal-free.

19. The toner for the development of electrostatic images of claim 1, wherein said aromatic ring residue is selected from the group consisting of a 5–10 member aromatic heterocyclic ring, a $C_6$–$C_{20}$ aromatic carbocyclic ring, and a condensed carbocyclic-heterocyclic structure.

* * * * *